US007687442B2

(12) United States Patent
Walton et al.

(10) Patent No.: US 7,687,442 B2
(45) **Date of Patent: *Mar. 30, 2010**

(54) LOW MOLECULAR WEIGHT ETHYLENE/α-OLEFIN INTERPOLYMER AS BASE LUBRICANT OILS

(75) Inventors: Kim L. Walton, Lake Jackson, TX (US); Morgan M. Hughes, Angleton, TX (US); Gary L. Rath, Pearland, TX (US); Yunwa W. Cheung, Lake Jackson, TX (US)

(73) Assignee: Dow Global Technologies Inc., Midland, MI (US)

( * ) Notice: Subject to any disclaimer, the term of this patent is extended or adjusted under 35 U.S.C. 154(b) by 959 days.

This patent is subject to a terminal disclaimer.

(21) Appl. No.: 11/376,774

(22) Filed: Mar. 15, 2006

(65) Prior Publication Data

US 2006/0199744 A1 Sep. 7, 2006

Related U.S. Application Data

(63) Continuation-in-part of application No. PCT/US2005/008917, filed on Mar. 17, 2005.

(60) Provisional application No. 60/717,875, filed on Sep. 16, 2005, provisional application No. 60/553,906, filed on Mar. 17, 2004.

(51) Int. Cl.
*C10M 169/00* (2006.01)

(52) U.S. Cl. ..... 508/110

(58) Field of Classification Search ..... 508/591, 508/110

See application file for complete search history.

(56) References Cited

U.S. PATENT DOCUMENTS

| | | | | |
|---|---|---|---|---|
| 2,973,344 | A | 2/1961 | Fasce | |
| 2,997,432 | A | 8/1961 | Koble et al. | |
| 3,873,642 | A | 3/1975 | Jezl | |
| 4,146,492 | A * | 3/1979 | Cusano et al. | 508/473 |
| 4,299,931 | A | 11/1981 | Coran et al. | |
| 4,429,079 | A | 1/1984 | Shibata et al. | |
| 4,510,031 | A | 4/1985 | Matsumura et al. | |
| 4,668,752 | A | 5/1987 | Tominari et al. | |
| 4,780,228 | A | 10/1988 | Gardiner et al. | |
| 4,798,081 | A | 1/1989 | Hazlitt et al. | |
| 5,068,047 | A | 11/1991 | Chung et al. | |
| 5,266,626 | A | 11/1993 | Hert et al. | |
| 5,322,728 | A | 6/1994 | Davey et al. | |
| 5,391,629 | A | 2/1995 | Turner et al. | |
| 5,468,810 | A | 11/1995 | Hayakawa et al. | |
| 5,594,080 | A | 1/1997 | Waymouth et al. | |
| 5,597,881 | A | 1/1997 | Winter et al. | |
| 5,610,253 | A | 3/1997 | Hatke et al. | |
| 5,624,991 | A | 4/1997 | Harada et al. | |
| 5,733,980 | A | 3/1998 | Cozewith et al. | |
| 5,783,531 | A * | 7/1998 | Andrew et al. | 508/510 |
| 5,798,420 | A * | 8/1998 | Cozewith et al. | 525/323 |
| 5,868,984 | A | 2/1999 | Winter et al. | |
| 5,892,076 | A | 4/1999 | Nickias | |
| 5,916,953 | A | 6/1999 | Jacoby et al. | |
| 5,969,070 | A | 10/1999 | Waymouth et al. | |
| 5,994,255 | A | 11/1999 | Nickias et al. | |
| 6,008,262 | A | 12/1999 | McKay et al. | |
| 6,025,448 | A | 2/2000 | Swindoll et al. | |
| 6,096,668 | A | 8/2000 | Abuto et al. | |
| 6,114,457 | A | 9/2000 | Markel et al. | |
| 6,121,402 | A | 9/2000 | Machida et al. | |
| 6,124,400 | A | 9/2000 | Chien | |
| 6,136,937 | A | 10/2000 | Lai et al. | |
| 6,147,180 | A | 11/2000 | Markel et al. | |
| 6,160,029 | A | 12/2000 | Chaudhary et al. | |
| 6,187,424 | B1 | 2/2001 | Kjellqvist et al. | |
| 6,197,404 | B1 | 3/2001 | Varona | |
| 6,262,203 | B1 | 7/2001 | Chien et al. | |
| 6,362,252 | B1 | 3/2002 | Prutkin | |
| 6,455,638 | B2 | 9/2002 | Laughner et al. | |
| 6,537,472 | B2 | 3/2003 | Masubichi | |

(Continued)

FOREIGN PATENT DOCUMENTS

EP 0 274 906 A2 7/1988

(Continued)

OTHER PUBLICATIONS

International Search Report and attached Written Opinion of the International Searching Authority mailed Aug. 3, 2006.

(Continued)

*Primary Examiner*—Glenn A Caldarola
*Assistant Examiner*—Taiwo Oladapo
(74) *Attorney, Agent, or Firm*—Whyte Hirschboeck Dudek SC

(57) ABSTRACT

A lubricant composition comprises an ethylene/α-olefin interpolymer having a number average molecular weight of less than 10,000 g/mol as a base oil and at least one oil additive. The ethylene/α-olefin interpolymer has at least one molecular fraction which elutes between 40° C. and 130° C. when fractionated using TREF, characterized in that the fraction has a molar comonomer content of at least 5 percent higher than that of a comparable random ethylene interpolymer fraction eluting between the same temperatures, wherein said comparable random ethylene interpolymer has the same comonomer(s) and has a melt index, density, and molar comonomer content (based on the whole polymer) within 10 percent of that of the ethylene/α-olefin interpolymer.

50 Claims, No Drawings

U.S. PATENT DOCUMENTS

| | | | | |
|---|---|---|---|---|
| 6,566,446 | B1 | 5/2003 | Parikh et al. | |
| 6,566,544 | B1 | 5/2003 | Waymouth et al. | |
| 6,815,023 | B1 | 11/2004 | Tatarka et al. | |
| 7,005,395 | B2 | 2/2006 | Zafiroglu et al. | |
| 2003/0027954 | A1 | 2/2003 | Becke et al. | |
| 2003/0195128 | A1 * | 10/2003 | Deckman et al. | 508/591 |
| 2003/0216518 | A1 | 11/2003 | Tau et al. | |
| 2004/0082750 | A1 | 4/2004 | Tau et al. | |
| 2004/0092662 | A1 | 5/2004 | Goto et al. | |
| 2004/0121922 | A1 | 6/2004 | Okada et al. | |
| 2004/0158011 | A1 | 8/2004 | Jain et al. | |
| 2004/0192147 | A1 | 9/2004 | Smith et al. | |
| 2005/0009993 | A1 | 1/2005 | Morioka et al. | |
| 2006/0030667 | A1 | 2/2006 | Yalvac et al. | |
| 2008/0299857 | A1 | 12/2008 | Harding et al. | |

FOREIGN PATENT DOCUMENTS

| | | | |
|---|---|---|---|
| EP | 0 877 050 | | 11/1998 |
| EP | 1 026 184 | | 8/2000 |
| EP | 0 958 313 | B1 | 9/2002 |
| EP | 1 262 498 | A2 | 12/2002 |
| EP | 1262498 | A2 | 12/2002 |
| JP | 2002-206007 | A | 7/2002 |
| JP | 2004-204058 | | 7/2004 |
| JP | 2004-204058 | A | 7/2004 |
| WO | WO 95/27745 | A1 | 10/1995 |
| WO | WO 95/27746 | A1 | 10/1995 |
| WO | 96/12762 | A1 | 5/1996 |
| WO | 97/12919 | A1 | 4/1997 |
| WO | WO 98/34970 | A1 | 8/1998 |
| WO | WO 99/35171 | A1 | 7/1999 |
| WO | WO 00/37514 | A1 | 6/2000 |
| WO | WO 02/066540 | A2 | 8/2002 |
| WO | WO 02/079322 | | 10/2002 |
| WO | WO 03/014046 | A1 | 2/2003 |
| WO | WO 2005/090425 | A1 | 9/2005 |
| WO | WO 2005/090426 | A1 | 9/2005 |
| WO | WO 2005/090427 | A2 | 9/2005 |

OTHER PUBLICATIONS

Arriola et al., "Catalytic Production of Olefin Block Copolymers via Chain Shuttling Polymerization", 312 Science (2006), pp. 714-719.

* cited by examiner

LOW MOLECULAR WEIGHT ETHYLENE/α-OLEFIN INTERPOLYMER AS BASE LUBRICANT OILS

CROSS-REFERENCE TO RELATED APPLICATIONS

This application claims priority to U.S. Provisional Application No. 60/717,875 filed Sep. 16, 2005, which further claims priority to PCT Application No. PCT/US2005/008917, filed on Mar. 17, 2005, which in turn claims priority to U.S. Provisional Application No. 60/553,906, filed Mar. 17, 2004. For purposes of United States patent practice, the contents of the provisional application and the PCT application are herein incorporated by reference in their entirety.

FIELD OF THE INVENTION

The invention relates to lubricant compositions containing a low molecular weight ethylene/α-olefin interpolymer as a base oil and optionally containing one or more additives.

BACKGROUND OF THE INVENTION

Modern lubricant compositions are widely used in various applications such as motor oils, transmission fluids, gear oils, power steering fluids, shock absorber fluids, brake fluids, hydraulic fluids and greases. The lubricant compositions can have various functions such as (1) controlling friction between surfaces of moving parts; (2) reducing wear of moving parts; (3) reducing corrosion of surfaces of moving parts, particularly metal surfaces; (4) damping mechanical shock in gears; and (5) forming a seal on the walls of engine cylinders. Each lubricant composition can contain a base oil and, depending on the application, a combination of additives or modifiers, such as viscosity index improvers, pour point depressants, dispersants, detergents, anti-wear agents, antioxidants, friction modifiers, rust inhibitors, corrosion inhibitors, demulsifiers and anti-foams.

The base oil in various lubricants are formulated from a range of natural or synthetic oils or polymers or various combinations thereof. The base oil has several functions; but primarily it is the lubricant, providing a fluid layer separating moving surfaces or removing heat and wear particles while keeping friction at a minimum. The base oil also functions as a carrier for various additives that enhance the properties of the lubricant. The base oil, therefore, is required to keep the additives in solution under all normal working conditions.

Poly-α-olefins ("PAOs") are synthetic hydrocarbons which are widely used as lubricant base oils. Various properties of PAOs make them suitable for use as lubricant base oils in engine oils, compressor oils, hydraulic oils, gear oils, and greases. However, PAOs that have been characterized to date have limited oxidative stability and limited biodegradability. The cost of producing PAOs is relative high. Therefore, it is desirable to manufacture a lubricant base oil that is more cost-effective and has improved in use life-time than the current base oils for lubricants.

SUMMARY OF THE INVENTION

The aforementioned needs are met by various aspects of the inventions. Provided herein are lubricant compositions comprising a base oil and at least one oil additive. The base oil comprises an ethylene/α-olefin interpolymer. In certain embodiments, the ethylene/α-olefin interpolymer has a number average molecular weight of less than about 10,000 g/mol and wherein the ethylene/α-olefin interpolymer has a molecular fraction which elutes between 40° C. and 130° C. when fractionated using TREF, characterized in that the fraction has a molar comonomer content of at least 5 percent higher than that of a comparable random ethylene interpolymer fraction eluting between the same temperatures, wherein said comparable random ethylene interpolymer has the same comonomer(s) and has a melt index, density, and molar comonomer content (based on the whole polymer) within 10 percent of that of the ethylene/α-olefin interpolymer.

In one embodiment, the ethylene/α-olefin interpolymer used in the lubricant compositions provided herein has at least one molecular fraction which elutes between 40° C. and 130° C. when fractionated using TREF, characterized in that the fraction has a block index of at least 0.5 and up to about 1 and a molecular weight distribution, Mw/Mn, greater than about 1.3.

In another embodiment, the ethylene/α-olefin interpolymer used in the lubricant compositions provided herein has an average block index greater than zero and up to about 1.0 and a molecular weight distribution, Mw/Mn, greater than about 1.3.

In one embodiment, the lubricant composition comprises the ethylene/α-olefin interpolymer that has a number average molecular weight range from about 1000 to about 5000 g/mole. In certain embodiments, the ethylene/α-olefin interpolymer has a molecular weight distribution range from about 1.5 to about 4.0. In certain embodiments, the ethylene/α-olefin interpolymer has a Brookfield viscosity from about 5 to about 30 cSt at 100° C. In certain embodiments, the ethylene/α-olefin interpolymer has a pour point of below about 0° C.

In another embodiment, the ethylene/α-olefin interpolymer comprises a $C_3$-$C_{20}$ α-olefin, a $C_6$-$C_{18}$ α-olefin or a $C_{10}$-$C_{20}$ α-olefin. In one embodiment, the ethylene/α-olefin interpolymer comprises decene or dodecene.

In one embodiment, the base oil in the lubricant compositions further comprises an oil selected from a group consisting of a base stock of API Groups I, II, III, IV, V and combinations thereof. In certain embodiments, the base oil further comprises a natural oil, a synthetic oil or a combination thereof.

In another embodiment, the additive in the compositions provided herein is a viscosity index improver, a detergent, a dispersant, a friction modifier, a pour point depressant, a demulsifier, an anti-foam, a corrosion inhibitor, an anti-wear agent, an antioxidant, a rust inhibitor, a thickener, or a combination thereof.

In one embodiment, the additive is a viscosity index improver. In one embodiment, the viscosity index improver is a higher molecular weight ethylene/α-olefin block copolymer.

In another embodiment, the lubricant composition is a motor oil, a transmission fluid, a gear oil, a power steering fluid, a shock absorber fluid, a brake fluid, a hydraulic fluid or a grease.

In one embodiment, the lubricant composition is a motor oil. In one embodiment, the motor oil further comprises a viscosity index improver, a pour point depressant, a detergent, a dispersant, an anti-wear, an antioxidant, a friction modifier, a rust inhibitor or a combination thereof.

In another embodiment, the lubricant composition is a transmission fluid. In one embodiment, the transmission fluid further comprises a viscosity index improver, a friction modifier, a detergent, a dispersant, an antioxidant, an anti-wear agent, an extreme pressure agent, a pour point depressant, an anti-foam, a corrosion inhibitor or a combination thereof.

In one embodiment, the lubricant composition is a gear oil. In one embodiment, the gear oil further comprises a viscosity index improver, an anti-wear, an extreme pressure agent, a rust inhibitor or a combination thereof.

In another embodiment, the lubricant composition is a grease. In one embodiment, the grease further comprises a viscosity index improver, a thickener, a complexing agent, an antioxidant, an anti-wear agent, an extreme pressure agent, an anti-foam, a corrosion inhibitor or a mixture thereof.

Methods of making the lubricant compositions comprising a base oil and at least one oil additive are also provided. The base oil and additives used herein are described above and elsewhere herein.

Additional aspects of the invention and characteristics and properties of various embodiments of the invention become apparent with the following description.

DESCRIPTION EMBODIMENTS OF THE INVENTION

General Definitions

Polymer" means a polymeric compound prepared by polymerizing monomers, whether of the same or a different type. The generic term "polymer" embraces the terms "homopolymer," "copolymer," "terpolymer" as well as "interpolymer."

"Interpolymer" means a polymer prepared by the polymerization of at least two different types of monomers. The generic term "interpolymer" includes the term "copolymer" (which is usually employed to refer to a polymer prepared from two different monomers) as well as the term "terpolymer" (which is usually employed to refer to a polymer prepared from three different types of monomers). It also encompasses polymers made by polymerizing four or more types of monomers.

The term "ethylene/α-olefin interpolymer" generally refers to polymers comprising ethylene and an α-olefin having 3 or more carbon atoms. Preferably, ethylene comprises the majority mole fraction of the whole polymer, i.e., ethylene comprises at least about 50 mole percent of the whole polymer. More preferably ethylene comprises at least about 60 mole percent, at least about 70 mole percent, or at least about 80 mole percent, with the substantial remainder of the whole polymer comprising at least one other comonomer that is preferably an α-olefin having 3 or more carbon atoms. For many ethylene/octene copolymers, the preferred composition comprises an ethylene content greater than about 80 mole percent of the whole polymer and an octene content of from about 10 to about 15, preferably from about 15 to about 20 mole percent of the whole polymer. In some embodiments, the ethylene/α-olefin interpolymers do not include those produced in low yields or in a minor amount or as a by-product of a chemical process. While the ethylene/α-olefin interpolymers can be blended with one or more polymers, the as-produced ethylene/α-olefin interpolymers are substantially pure and often comprise a major component of the reaction product of a polymerization process.

The ethylene/α-olefin interpolymers comprise ethylene and one or more copolymerizable α-olefin comonomers in polymerized form, characterized by multiple blocks or segments of two or more polymerized monomer units differing in chemical or physical properties. That is, the ethylene/α-olefin interpolymers are block interpolymers, preferably multi-block interpolymers or copolymers. The terms "interpolymer" and "copolymer" are used interchangeably herein. In some embodiments, the multi-block copolymer can be represented by the following formula:

$$(AB)_n$$

where n is at least 1, preferably an integer greater than 1, such as 2, 3, 4, 5, 10, 15, 20, 30, 40, 50, 60, 70, 80, 90, 100, or higher, "A" represents a hard block or segment and "B" represents a soft block or segment. Preferably, As and Bs are linked in a substantially linear fashion, as opposed to a substantially branched or substantially star-shaped fashion. In other embodiments, A blocks and B blocks are randomly distributed along the polymer chain. In other words, the block copolymers usually do not have a structure as follows.

AAA-AA-BBB-BB

In still other embodiments, the block copolymers do not usually have a third type of block, which comprises different comonomer(s). In yet other embodiments, each of block A and block B has monomers or comonomers substantially randomly distributed within the block. In other words, neither block A nor block B comprises two or more sub-segments (or sub-blocks) of distinct composition, such as a tip segment, which has a substantially different composition than the rest of the block.

The multi-block polymers typically comprise various amounts of "hard" and "soft" segments. "Hard" segments refer to blocks of polymerized units in which ethylene is present in an amount greater than about 95 weight percent, and preferably greater than about 98 weight percent based on the weight of the polymer. In other words, the comonomer content (content of monomers other than ethylene) in the hard segments is less than about 5 weight percent, and preferably less than about 2 weight percent based on the weight of the polymer. In some embodiments, the hard segments comprises all or substantially all ethylene. "Soft" segments, on the other hand, refer to blocks of polymerized units in which the comonomer content (content of monomers other than ethylene) is greater than about 5 weight percent, preferably greater than about 8 weight percent, greater than about 10 weight percent, or greater than about 15 weight percent based on the weight of the polymer. In some embodiments, the comonomer content in the soft segments can be greater than about 20 weight percent, greater than about 25 weight percent, greater than about 30 weight percent, greater than about 35 weight percent, greater than about 40 weight percent, greater than about 45 weight percent, greater than about 50 weight percent, or greater than about 60 weight percent.

The soft segments can often be present in a block interpolymer from about 1 weight percent to about 99 weight percent of the total weight of the block interpolymer, preferably from about 5 weight percent to about 95 weight percent, from about 10 weight percent to about 90 weight percent, from about 15 weight percent to about 85 weight percent, from about 20 weight percent to about 80 weight percent, from about 25 weight percent to about 75 weight percent, from about 30 weight percent to about 70 weight percent, from about 35 weight percent to about 65 weight percent, from about 40 weight percent to about 60 weight percent, or from about 45 weight percent to about 55 weight percent of the total weight of the block interpolymer. Conversely, the hard segments can be present in similar ranges. The soft segment weight percentage and the hard segment weight percentage can be calculated based on data obtained from DSC or NMR. Such methods and calculations are disclosed in a concurrently filed U.S. patent application Ser. No. 12/558,234, entitled "Ethylene/α-Olefin Block Interpolymers", filed on Mar. 15, 2006, in the name of Colin L. P. Shan, Lonnie Hazlitt, et. al. and assigned to Dow Global Technologies Inc., the disclose of which is incorporated by reference herein in its entirety.

The term "pour point" as used herein refers to the lowest temperature at which the oil can be poured, as measured using ASTM D 97.

The term "multi-block copolymer" or "segmented copolymer" refers to a polymer comprising two or more chemically distinct regions or segments (referred to as "blocks") preferably joined in a linear manner, that is, a polymer comprising chemically differentiated units which are joined end-to-end with respect to polymerized ethylenic functionality, rather than in pendent or grafted fashion. In a preferred embodiment, the blocks differ in the amount or type of comonomer incorporated therein, the density, the amount of crystallinity, the crystallite size attributable to a polymer of such composition, the type or degree of tacticity (isotactic or syndiotactic), regio-regularity or regio-irregularity, the amount of branching, including long chain branching or hyper-branching, the homogeneity, or any other chemical or physical property. The multi-block copolymers are characterized by unique distributions of both polydispersity index (PDI or Mw/Mn), block length distribution, and/or block number distribution due to the unique process making of the copolymers. More specifically, when produced in a continuous process, the polymers desirably possess PDI from 1.7 to 2.9, preferably from 1.8 to 2.5, more preferably from 1.8 to 2.2, and most preferably from 1.8 to 2.1. When produced in a batch or semi-batch process, the polymers possess PDI from 1.0 to 2.9, preferably from 1.3 to 2.5, more preferably from 1.4 to 2.0, and most preferably from 1.4 to 1.8.

In the following description, all numbers provided herein are approximate values, regardless whether the word "about" or "approximate" is used in connection therewith. They may vary by 1 percent, 2 percent, 5 percent, or, sometimes, 10 to 20 percent. Whenever a numerical range with a lower limit, $R^L$ and an upper limit, $R^U$, is disclosed, any number falling within the range is specifically disclosed. In particular, the following numbers within the range are specifically disclosed: $R=R^L+k*(R^U-R^L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

Lubricant Compositions

Provided herein are lubricant compositions comprising: (a) a base oil; and (b) an oil additive, wherein the base oil comprises a low molecular weight ethylene/α-olefin interpolymer. The amount of base oil in the lubricant compositions provided herein can be more than about 50% by weight of the total composition. In certain embodiments, the base oil can be from about 50% up to about 99.99% by weight, from about 60% up to about 90%, from about 70% up to about 80% by weight of the total composition. In certain embodiments, the base oil in the composition is about 50%, about 60%, about 70%, about 75%, about 80%, about 85%, about 90%, about 99% or about 99.99% by weight of the total composition. In some embodiments, the lubricant compositions have a kinematic viscosity at 40° C. between 5 and 250 $mm^2$/sec; and the total acid value thereof (according to indicator method) preferably falls between 0.01 and 0.5 mg KOH/g.

Base Oils

The lubricant compositions provided herein can contain the low molecular weight ethylene/α-olefin interpolymer alone as the base oil or as a blend with other base oils known in the art. The amount of the low molecular weight ethylene/α-olefin interpolymer in the base oil in the lubricant compositions provided herein can be more than about 50% by weight of the total weight of the base oil. In certain embodiments, the amount of the low molecular weight ethylene/α-olefin interpolymer in the base oil can vary from about 50% by weight up to about 100% by weight, from about 60% up to about 95%, from about 70% up to about 90% by weight of the base oil. In certain embodiments, the amount of the low molecular weight ethylene/α-olefin interpolymer in the base oil in the lubricating compositions provided herein is about 50%, about 60%, about 70%, about 75%, about 80%, about 85%, about 90%, about 95%, about 99%, about 100% by weight of the base oil.

The Low Molecular Weight Ethylene/α-Olefin Interpolymers

The low molecular weight ethylene/α-olefin interpolymers used in the lubricant compositions provided herein contain ethylene and one or more copolymerizable α-olefin comonomers in polymerized form, characterized by multiple blocks or segments of two or more polymerized monomer units differing in chemical or physical properties (block interpolymer), in certain embodiments, a multi-block copolymer.

In some embodiments, the low molecular weight ethylene/α-olefin interpolymers have a molecular fraction which elutes between 40° C. and 130° C. when fractionated using Temperature Rising Elution Fractionation ("TREF"), characterized in that said fraction has a molar comonomer content higher, preferably at least 5 percent higher, more preferably at least 10 percent higher, than that of a comparable random ethylene interpolymer fraction eluting between the same temperatures, wherein the comparable random ethylene interpolymer contains the same comonomer(s), and has a melt index, density, and molar comonomer content (based on the whole polymer) within 10 percent of that of the block interpolymer. Preferably, the Mw/Mn of the comparable interpolymer is also within 10 percent of that of the block interpolymer and/or the comparable interpolymer has a total comonomer content within 10 weight percent of that of the block interpolymer.

In other embodiments, the inventive low molecular weight ethylene/α-olefin interpolymer is characterized by an average block index, ABI, which is greater than zero and up to about 1.0 and a molecular weight distribution, $M_w/M_n$, greater than about 1.3. The average block index, ABI, is the weight average of the block index for each of the polymer fractions obtained in preparative TREF from 20° C. and 110° C., with an increment of 5° C.:

$$ABI=\Sigma(w_i BI_i)$$

where $BI_i$ is the block index for ith fraction of the inventive ethylene/α-olefin interpolymer obtained in preparative TREF, and $w_i$ is the weight percentage of the ith fraction.

For each polymer fraction, BI is defined by one of the two following equations (both of which give the same BI value):

$$BI = \frac{1/T_X - 1/T_{XO}}{1/T_A - 1/T_{AB}} \text{ or } BI = -\frac{LnP_X - LnP_{XO}}{LnP_A - LnP_{AB}}$$

where $T_X$ is the preparative ATREF elution temperature for the ith fraction (preferably expressed in Kelvin), $P_X$ is the ethylene mole fraction for the ith fraction, which can be measured by NMR or IR as described below. $P_{AB}$ is the ethylene mole fraction of the whole ethylene/α-olefin interpolymer (before fractionation), which also can be measured by NMR or IR. $T_A$ and $P_A$ are the ATREF elution temperature and the ethylene mole fraction for pure "hard segments" (which refer to the crystalline segments of the interpolymer). As first order approximation, the $T_A$ and $P_A$ values are set to those for high density polyethylene homopolymer, if the actual values for the "hard segments" are not available. For calculations performed herein, $T_A$ is 372° K, $P_A$ is 1.

$T_{AB}$ is the ATREF temperature for a random copolymer of the same composition and having an ethylene mole fraction of $P_{AB}$. $T_{AB}$ can be calculated from the following equation:

$$\text{Ln } P_{AB}=\alpha/T_{AB}+\beta$$

where α and β are two constants which can be determined by calibration using a number of known random ethylene copolymers. It should be noted that α and β may vary from instrument to instrument. Moreover, one would need to create their own calibration curve with the polymer composition of interest and also in a similar molecular weight range as the fractions. There is a slight molecular weight effect. If the calibration curve is obtained from similar molecular weight ranges, such effect would be essentially negligible. In some embodiments, random ethylene copolymers satisfy the following relationship:

$$\text{Ln } P=-237.83/T_{ATREF}+0.639$$

$T_{XO}$ is the ATREF temperature for a random copolymer of the same composition and having an ethylene mole fraction of $P_X$. $T_{XO}$ can be calculated from $\text{Ln } P_X=\alpha/T_{XO}+\beta$. Conversely, $P_{XO}$ is the ethylene mole fraction for a random copolymer of the same composition and having an ATREF temperature of $T_X$, which can be calculated from $\text{Ln } P_{XO}=\alpha/T_X+\beta$.

Once the block index for each preparative TREF fraction is obtained, the weight average block index, ABI, for the whole polymer can be calculated. In some embodiments, ABI is greater than zero but less than about 0.3 or from about 0.1 to about 0.3. In other embodiments, ABI is greater than about 0.3 and up to about 1.0. Preferably, ABI should be in the range of from about 0.4 to about 0.7, from about 0.5 to about 0.7, or from about 0.6 to about 0.9. In some embodiments, ABI is in the range of from about 0.3 to about 0.9, from about 0.3 to about 0.8, or from about 0.3 to about 0.7, from about 0.3 to about 0.6, from about 0.3 to about 0.5, or from about 0.3 to about 0.4. In other embodiments, ABI is in the range of from about 0.4 to about 1.0, from about 0.5 to about 1.0, or from about 0.6 to about 1.0, from about 0.7 to about 1.0, from about 0.8 to about 1.0, or from about 0.9 to about 1.0.

Another characteristic of the inventive low molecular weight ethylene/α-olefin interpolymer is that the inventive ethylene/α-olefin interpolymer comprises at least one polymer fraction which can be obtained by preparative TREF, wherein the fraction has a block index greater than about 0.1 and up to about 1.0 and a molecular weight distribution, $M_w/M_n$, greater than about 1.3. In some embodiments, the polymer fraction has a block index greater than about 0.6 and up to about 1.0, greater than about 0.7 and up to about 1.0 greater than about 0.8 and up to about 1.0, or greater than about 0.9 and up to about 1.0. In other embodiments, the polymer fraction has a block index greater than about 0.1 and up to about 1.0, greater than about 0.2 and up to about 1.0, greater than about 0.3 and up to about 1.0, greater than about 0.4 and up to about 1.0, or greater than about 0.4 and up to about 1.0. In still other embodiments, the polymer fraction has a block index greater than about 0.1 and up to about 0.5, greater than about 0.2 and up to about 0.5, greater than about 0.3 and up to about 0.5, or greater than about 0.4 and up to about 0.5. In yet other embodiments, the polymer fraction has a block index greater than about 0.2 and up to about 0.9, greater than about 0.3 and up to about 0.8, greater than about 0.4 and up to about 0.7, or greater than about 0.5 and up to about 0.6.

Comonomer content may be measured using any suitable technique, with techniques based on nuclear magnetic resonance (NMR) spectroscopy preferred. Moreover, for polymers or blends of polymers having relatively broad TREF curves, the polymer desirably is first fractionated using TREF into fractions each having an eluted temperature range of 10° C. or less. That is, each eluted fraction has a collection temperature window of 10° C. or less. Using this technique, said blocked interpolymers have at least one such fraction having a higher molar comonomer content than a corresponding fraction of the comparable interpolymer.

In another aspect, the inventive polymer is an olefin interpolymer, preferably comprising ethylene and one or more copolymerizable comonomers in polymerized form, characterized by multiple blocks or segments of two or more polymerized monomer units differing in chemical or physical properties (blocked interpolymer), most preferably a multiblock copolymer, said block interpolymer having a peak (but not just a molecular fraction) which elutes between 40° C. and 130° C. (but without collecting and/or isolating individual fractions), characterized in that said peak, has a comonomer content estimated by infra-red spectroscopy when expanded using a full width/half maximum (FWHM) area calculation, has an average molar comonomer content higher, preferably at least 5 percent higher, more preferably at least 10, 15, 20 or 25 percent higher, than that of a comparable random ethylene interpolymer peak at the same elution temperature and expanded using a full width/half maximum (FWHM) area calculation, wherein said comparable random ethylene interpolymer comprises the same comonomer(s), preferably it is the same comonomer, and has a melt index, density, and molar comonomer content (based on the whole polymer) within 10 percent of that of the blocked interpolymer. Preferably, the Mw/Mn of the comparable interpolymer is also within 10 percent of that of the blocked interpolymer and/or the comparable interpolymer has a total comonomer content within 10 weight percent of that of the blocked interpolymer. The full width/half maximum (FWHM) calculation is based on the ratio of methyl to methylene response area [$CH_3/CH_2$] from the ATREF infra-red detector, wherein the tallest (highest) peak is identified from the base line, and then the FWHM area is determined. For a distribution measured using an ATREF peak, the FWHM area is defined as the area under the curve between T1 and T2, where T1 and T2 are points determined, to the left and right of the ATREF peak, by dividing the peak height by two, and then drawing a line horizontal to the base line, that intersects the left and right portions of the ATREF curve. A calibration curve for comonomer content is made using random ethylene/alpha-olefin copolymers, plotting comonomer content from NMR versus FWHM area ratio of the TREF peak. For this infra-red method, the calibration curve is generated for the same comonomer type of interest. The comonomer content of TREF peak of the inventive polymer can be determined by referencing this calibration curve using its FWHM methyl:methylene area ratio [$CH_3/CH_2$] of the TREF peak.

Comonomer content may be measured using any suitable technique, with techniques based on nuclear magnetic resonance (NMR) spectroscopy preferred. Using this technique, said blocked interpolymers has higher molar comonomer content than a corresponding comparable interpolymer.

Preferably, for the above interpolymers of ethylene and at least one alpha-olefin especially those interpolymers having a whole polymer density from about 0.855 to about 0.935 g/cm$^3$, and more especially for polymers having more than about 1 mole percent comonomer, the blocked interpolymer has a comonomer content of the TREF fraction eluting between 40 and 130° C. greater than or equal to the quantity (−0.2013)T+20.07, more preferably greater than or equal to the quantity (−0.2013)T+21.07, where T is the numerical value of the peak elution temperature of the TREF fraction being compared, measured in ° C.

ATREF Peak Comonomer Composition Measurement by Infra-Red Detector

The comonomer composition of the TREF peak can be measured using an IR4 infra-red detector available from Polymer Char, Valencia, Spain (http://www.polymerchar.com/).

The "composition mode" of the detector is equipped with a measurement sensor ($CH_2$) and composition sensor ($CH_3$) that are fixed narrow band infra-red filters in the region of 2800-3000 cm$^{-1}$. The measurement sensor detects the methylene ($CH_2$) carbons on the polymer (which directly relates to the polymer concentration in solution) while the composition sensor detects the methyl ($CH_3$) groups of the polymer. The mathematical ratio of the composition signal ($CH_3$) divided by the measurement signal ($CH_2$) is sensitive to the comonomer content of the measured polymer in solution and its response is calibrated with known ethylene alpha-olefin copolymer standards.

The detector when used with an ATREF instrument provides both a concentration ($CH_2$) and composition ($CH_3$) signal response of the eluted polymer during the TREF process. A polymer specific calibration can be created by measuring the area ratio of the $CH_3$ to $CH_2$ for polymers with known comonomer content (preferably measured by NMR). The comonomer content of an ATREF peak of a polymer can be estimated by applying a the reference calibration of the ratio of the areas for the individual $CH_3$ and $CH_2$ response (i.e. area ratio $CH_3/CH_2$ versus comonomer content).

The area of the peaks can be calculated using a full width/half maximum (FWHM) calculation after applying the appropriate baselines to integrate the individual signal responses from the TREF chromatogram. The full width/half maximum calculation is based on the ratio of methyl to methylene response area [$CH_3/CH_2$] from the ATREF infra-red detector, wherein the tallest (highest) peak is identified from the base line, and then the FWHM area is determined. For a distribution measured using an ATREF peak, the FWHM area is defined as the area under the curve between T1 and T2, where T1 and T2 are points determined, to the left and right of the ATREF peak, by dividing the peak height by two, and then drawing a line horizontal to the base line, that intersects the left and right portions of the ATREF curve.

The application of infra-red spectroscopy to measure the comonomer content of polymers in this ATREF-infra-red method is, in principle, similar to that of GPC/FTIR systems as described in the following references: Markovich, Ronald P.; Hazlitt, Lonnie G.; Smith, Linley; "Development of gel-permeation chromatography-Fourier transform infrared spectroscopy for characterization of ethylene-based polyolefin copolymers". Polymeric Materials Science and Engineering (1991), 65, 98-100.; and Deslauriers, P. J.; Rohlfing, D. C.; Shieh, E. T.; Quantifying short chain branching microstructures in ethylene-1-olefin copolymers using size exclusion chromatography and Fourier transform infrared spectroscopy (SEC-FTIR), Polymer (2002), 43, 59-170., both of which are incorporated by reference herein in their entirety.

In certain embodiments, the α-olefins used in the low molecular weight ethylene/α-olefin interpolymers provided herein may be $C_3$-$C_{20}$ α-olefins, $C_6$-$C_{18}$ α-olefins or $C_{10}$-$C_{12}$ α-olefins. In certain embodiments, α-olefins for use herein are decene or dodecene. The block composition of these copolymers is, in certain embodiments, greater than 50 mole % α-olefins for the high α-olefin content blocks and about 20-30 mole % α-olefin for the low α-olefin content blocks. In some embodiments, sufficient α-olefin is added to ensure a fully amorphous composition in both the blocks. In certain embodiments, the range of high α-olefin content to low α-olefin content block ration may range from 5/95%-95/5%.

Generally, the interpolymer used in the base oil provided herein has a number average molecular weight, Mn, below 10,000 g/mole. In certain embodiments, the interpolymer has a number average molecular weight range Mn, from 1,000 up to 10,000 g/mole, from 1,000 up to 7,000 g/mole, from 1,000 up to 5,000 g/mole or from 2,000 up to 5,000 g/mole. The low molecular weight ethylene/α-olefin interpolymers range in viscosity from about 5 to about 30 cSt at 100° C. as measured by techniques known in the art, for example, via Brookfield viscometry. In certain embodiments, the low molecular weight ethylene/α-olefin interpolymers herein have a molecular weight distribution range of 1.5-4.0. In some embodiments, the pour point of the low molecular weight ethylene/α-olefin interpolymers is below 0° C.

Preferably, for interpolymers of ethylene and 1-octene, the block interpolymer has a comonomer content of the TREF fraction eluting between 40 and 130° C. greater than or equal to the quantity (−0.2013)T+20.07, more preferably greater than or equal to the quantity (−0.2013)T+21.07, where T is the numerical value of the peak elution temperature of the TREF fraction being compared, measured in ° C.

For copolymers of ethylene and an α-olefin, the inventive low molecular weight polymers preferably possess (1) a PDI of at least 1.3, more preferably at least 1.5, at least 1.7, or at least 2.0, and most preferably at least 2.6, up to a maximum value of 5.0, more preferably up to a maximum of 3.5, and especially up to a maximum of 2.7; and/or (2) an ethylene content of at least 50 weight percent.

The process of making the polymers has been disclosed in the following patent applications: U.S. Provisional Application No. 60/553,906, filed Mar. 17, 2004; U.S. Provisional Application No. 60/662,937, filed Mar. 17, 2005; U.S. Provisional Application No. 60/662,939, filed Mar. 17, 2005; U.S. Provisional Application No. 60/662,938, filed Mar. 17, 2005; PCT Application No. PCT/US2005/008916, filed Mar. 17, 2005; PCT Application No. PCT/US2005/008915, filed Mar. 17, 2005; and PCT Application No. PCT/US2005/008917, filed Mar. 17, 2005, all of which are incorporated by reference herein in their entirety. For example, one such method contains contacting ethylene and optionally one or more addition polymerizable monomers other than ethylene under addition polymerization conditions with a catalyst composition comprising:

the admixture or reaction product resulting from combining:

a first olefin polymerization catalyst having a high comonomer incorporation index, a second olefin polymerization catalyst having a comonomer incorporation index less than 90 percent, preferably less than 50 percent, most preferably less than 5 percent of the comonomer incorporation index of catalyst (A), and a chain shuttling agent.

Representative catalysts and chain shuttling agent are as follows. Catalyst (A1) is [N-(2,6-di(1-methylethyl)phenyl)amido)(2-isopropylphenyl)(α-naphthalen-2-diyl(6-pyridin-2-diyl)methane)]hafnium dimethyl, prepared according to the teachings of WO 03/40195, 2003US0204017, U.S. Ser. No. 10/429,024, filed May 2, 2003, and WO 04/24740.

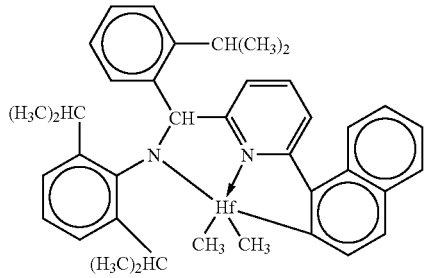

Catalyst (A2) is [N-(2,6-di(1-methylethyl)phenyl)amido)(2-methylphenyl)(1,2-phenylene-(6-pyridin-2-diyl)methane)]hafnium dimethyl, prepared according to the teachings of WO 03/40195, 2003US0204017, U.S. Ser. No. 10/429,024, filed May 2, 2003, and WO 04/24740.

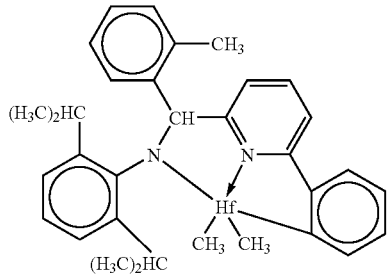

Catalyst (A3) is bis[N,N'''-(2,4,6-tri(methylphenyl)amido)ethylenediamine]hafnium dibenzyl:

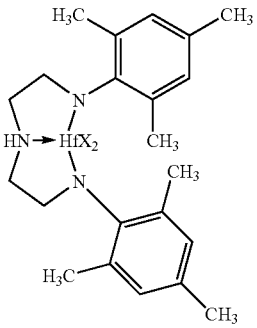

X = $CH_2C_6H_5$

Catalyst (A4) is bis((2-oxoyl-3-(dibenzo-1H-pyrrole-1-yl)-5-(methyl)phenyl)-2-phenoxymethyl)cyclohexane-1,2-diyl zirconium (IV) dibenzyl, prepared substantially according to the teachings of US-A-2004/0010103.

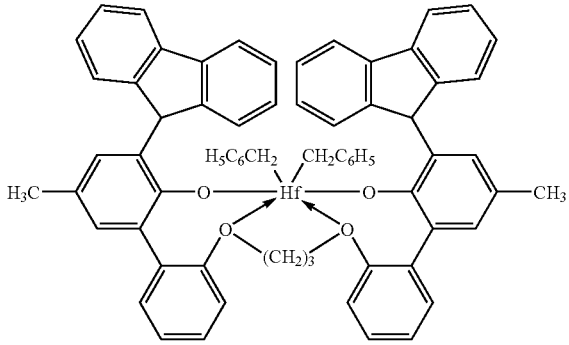

Catalyst (B1) is 1,2-bis-(3,5-di-t-butylphenylene)(1-(N-(1-methylethyl)immino)methyl)(2-oxoyl) zirconium dibenzyl:

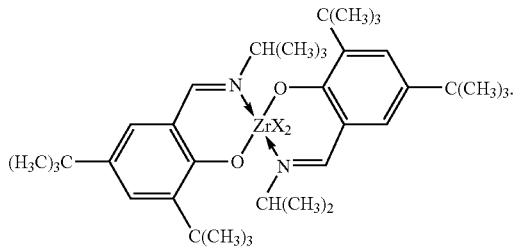

X = $CH_2C_6H_5$

Catalyst (B2) is 1,2-bis-(3,5-di-t-butylphenylene)(1-(N-(2-methylcyclohexyl)-immino)methyl)(2-oxoyl) zirconium dibenzyl:

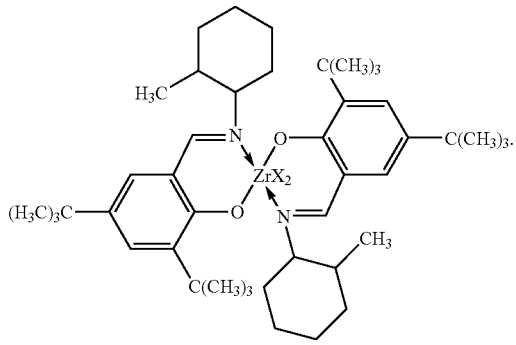

X = $CH_2C_6H_5$

Catalyst (C1) is (t-butylamido)dimethyl(3-N-pyrrolyl-1,2,3,3a,7a-η-inden-1-yl)silanetitanium dimethyl prepared substantially according to the techniques of U.S. Pat. No. 6,268,444:

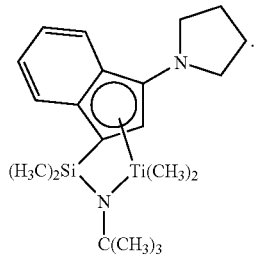

Catalyst (C2) is (t-butylamido)di(4-methylphenyl)(2-methyl-1,2,3,3a-η-inden-1-yl)silanetitanium dimethyl prepared substantially according to the teachings of US-A-2003/004286:

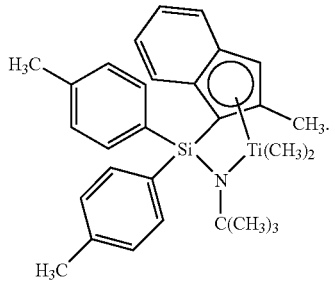

Catalyst (C3) is (t-butylamido)di(4-methylphenyl)(2-methyl-1,2,3,3a-η-s-indacen-1-yl)silanetitanium dimethyl prepared substantially according to the teachings of US-A-2003/004286:

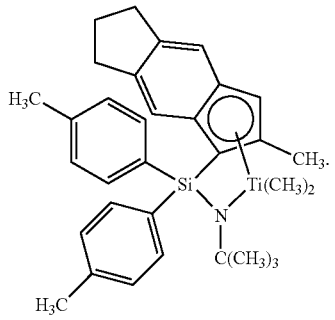

Catalyst (D1) is bis(dimethyldisiloxane)(indene-1-yl)zirconium dichloride available from Sigma-Aldrich:

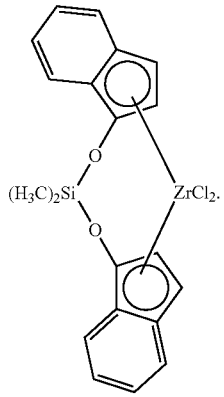

Shuttling Agents The shuttling agents employed include diethylzinc, di(i-butyl)zinc, di(n-hexyl)zinc, triethylaluminum, trioctylaluminum, triethylgallium, i-butylaluminum bis(dimethyl(t-butyl)siloxane), i-butylaluminum bis(di(trimethylsilyl)amide), n-octylaluminum di(pyridine-2-methoxide), bis(n-octadecyl)i-butylaluminum, i-butylaluminum bis(di(n-pentyl)amide), n-octylaluminum bis(2,6-di-t-butylphenoxide, n-octylaluminum di(ethyl(1-naphthyl)amide), ethylaluminum bis(t-butyldimethylsiloxide), ethylaluminum di(bis(trimethylsilyl)amide), ethylaluminum bis(2,3,6,7-dibenzo-1-azacycloheptaneamide), n-octylaluminum bis(2,3,6,7-dibenzo-1-azacycloheptaneamide), n-octylaluminum bis(dimethyl(t-butyl)siloxide, ethylzinc (2,6-diphenylphenoxide), and ethylzinc (t-butoxide).

Preferably, the foregoing process takes the form of a continuous solution process for forming block copolymers, especially multi-block copolymers, preferably linear multi-block copolymers of two or more monomers, more especially ethylene and a $C_{3-20}$ olefin or cycloolefin, and most especially ethylene and a $C_{4-2}$ α-olefin, using multiple catalysts that are incapable of interconversion. That is the catalysts are chemically distinct. Under continuous solution polymerization conditions, the process is ideally suited for polymerization of mixtures of monomers at high monomer conversions. Under these polymerization conditions, shuttling from the chain shuttling agent to the catalyst becomes advantaged compared to chain growth, and multi-block copolymers, especially linear multi-block copolymers are formed in high efficiency.

The inventive interpolymers may be differentiated from conventional, random copolymers, physical blends of polymers, and block copolymers prepared via sequential monomer addition, fluxional catalysts, anionic or cationic living polymerization techniques. In particular, the inventive interpolymers can contain blocks of differing comonomer content (including homopolymers blocks). The inventive interpolymers may also contain a distribution in number and/or block size of polymer blocks of differing density or comonomer content, which is a Schultz-Flory type of distribution.

Moreover, the inventive interpolymers may be prepared using techniques to influence the degree or level of blockiness. That is the amount of comonomer and length of each polymer block or segment can be altered by controlling the ratio and type of catalysts and shuttling agent as well as the temperature of the polymerization, and other polymerization variables. In particular, haze decreases while clarity, tear strength, and high temperature recovery properties increase as the average number of blocks in the polymer increases. By selecting shuttling agents and catalyst combinations having the desired chain transferring ability (high rates of shuttling with low levels of chain termination) other forms of polymer termination are effectively suppressed. Accordingly, little if any β-hydride elimination is observed in the polymerization of ethylene/α-olefin comonomer mixtures according to embodiments of the invention, and the resulting crystalline blocks are highly, or substantially completely, linear, possessing little or no long chain branching.

The interpolymers may further contain $C_4$-$C_{18}$ diolefin and/or alkenylbenzene. Suitable unsaturated comonomers useful for polymerizing with ethylene include, for example, ethylenically unsaturated monomers, conjugated or nonconjugated dienes, polyenes, alkenylbenzenes, etc. Examples of such comonomers include $C_3$-$C_{20}$ β-olefins such as propylene, isobutylene, 1-butene, 1-hexene, 1-pentene, 4-methyl-1-pentene, 1-heptene, 1-octene, 1-nonene, 1-decene, and the like. 1-Butene and 1-octene are especially preferred. Other suitable monomers include styrene, halo- or alkyl-substituted styrenes, vinylbenzocyclobutane, 1,4-hexadiene, 1,7-octadiene, and naphthenics (e.g., cyclopentene, cyclohexene and cyclooctene).

While ethylene/α-olefin interpolymers are preferred polymers, other ethylene/olefin polymers may also be used. Olefins as used herein refer to a family of unsaturated hydrocarbon-based compounds with at least one carbon-carbon double bond. Depending on the selection of catalysts, any olefin may be used in embodiments of the invention. Preferably, suitable olefins are $C_{3-20}$ aliphatic and aromatic compounds containing vinylic unsaturation, as well as cyclic compounds, such as cyclobutene, cyclopentene, dicyclopentadiene, and norbornene, including but not limited to, norbornene substituted in the 5 and 6 position with $C_{1-20}$ hydrocarbyl or cyclohydrocarbyl groups. Also included are mixtures of such olefins as well as mixtures of such olefins with $C_{4-40}$ diolefin compounds.

Examples of olefin monomers include, but are not limited to propylene, isobutylene, 1-butene, 1-pentene, 1-hexene, 1-heptene, 1-octene, 1-nonene, 1-decene, 1-dodecene, 1-tetradecene, 1-hexadecene, 1-octadecene, 1-eicosene, 3-methyl-1-butene, 3-methyl-1-pentene, 4-methyl-1-pentene, 4,6-dimethyl-1-heptene, 4-vinylcyclohexene, vinylcyclohexane, norbornadiene, ethylidene norbornene, cyclopentene, cyclohexene, dicyclopentadiene, cyclooctene, $C_{4-40}$ dienes, including but not limited to 1,3-butadiene, 1,3-pentadiene, 1,4-hexadiene, 1,5-hexadiene, 1,7-octadiene, 1,9-decadiene, other $C_{4-40}$ α-olefins, and the like. Although any hydrocarbon containing a vinyl group potentially may be used in embodiments of the invention, practical issues such as monomer availability, cost, and the ability to conveniently remove unreacted monomer from the resulting polymer may become more problematic as the molecular weight of the monomer becomes too high.

The polymerization processes described herein are well suited for the production of olefin polymers comprising monovinylidene aromatic monomers including styrene, o-methyl styrene, p-methyl styrene, t-butylstyrene, and the like. In particular, interpolymers containing ethylene and styrene can be prepared by following the teachings herein. Optionally, copolymers comprising ethylene, styrene and a $C_{3-20}$ alpha olefin, optionally comprising a $C_{4-20}$ diene, having improved properties can be prepared.

Suitable non-conjugated diene monomers can be a straight chain, branched chain or cyclic hydrocarbon diene having from 6 to 15 carbon atoms. Examples of suitable non-conjugated dienes include, but are not limited to, straight chain acyclic dienes, such as 1,4-hexadiene, 1,6-octadiene, 1,7-octadiene, 1,9-decadiene, branched chain acyclic dienes, such as 5-methyl-1,4-hexadiene; 3,7-dimethyl-1,6-octadiene; 3,7-dimethyl-1,7-octadiene and mixed isomers of dihydromyricene and dihydroocinene, single ring alicyclic dienes, such as 1,3-cyclopentadiene; 1,4-cyclohexadiene; 1,5-cyclooctadiene and 1,5-cyclododecadiene, and multi-ring alicyclic fused and bridged ring dienes, such as tetrahydroindene, methyl tetrahydroindene, dicyclopentadiene, bicyclo-(2,2,1)-hepta-2,5-diene; alkenyl, alkylidene, cycloalkenyl and cycloalkylidene norbornenes, such as 5-methylene-2-norbornene (MNB); 5-propenyl-2-norbornene, 5-isopropylidene-2-norbornene, 5-(4-cyclopentenyl)-2-norbornene, 5-cyclohexylidene-2-norbornene, 5-vinyl-2-norbornene, and norbornadiene. Of the dienes typically used to prepare EPDMs, the particularly preferred dienes are 1,4-hexadiene (HD), 5-ethylidene-2-norbornene (ENB), 5-vinylidene-2-norbornene (VNB), 5-methylene-2-norbornene (MNB), and dicyclopentadiene (DCPD). The especially preferred dienes are 5-ethylidene-2-norbornene (ENB) and 1,4-hexadiene (HD).

One class of desirable polymers that can be made in accordance with embodiments of the invention are interpolymers of ethylene, a $C_{3-20}$ α-olefin, especially propylene, and optionally one or more diene monomers. Preferred α-olefins for use in this embodiment of the present invention are designated by the formula $CH_2{=}CHR^*$, where R* is a linear or branched alkyl group of from 1 to 12 carbon atoms. Examples of suitable α-olefins include, but are not limited to, propylene, isobutylene, 1-butene, 1-pentene, 1-hexene, 4-methyl-1-pentene, and 1-octene. A particularly preferred α-olefin is propylene. The propylene based polymers are generally referred to in the art as EP or EPDM polymers.

Suitable dienes for use in preparing such polymers, especially multi-block EPDM type polymers include conjugated or non-conjugated, straight or branched chain-, cyclic- or polycyclic-dienes containing from 4 to 20 carbons. Preferred dienes include 1,4-pentadiene, 1,4-hexadiene, 5-ethylidene-2-norbornene, dicyclopentadiene, cyclohexadiene, and 5-butylidene-2-norbornene. A particularly preferred diene is 5-ethylidene-2-norbornene.

The ethylene/α-olefin interpolymers can be functionalized by incorporating at least one functional group in its polymer structure. Exemplary functional groups may include, for example, ethylenically unsaturated mono- and di-functional carboxylic acids, ethylenically unsaturated mono- and di-functional carboxylic acid anhydrides, salts thereof and esters thereof. Such functional groups may be grafted to an ethylene/α-olefin interpolymer, or it may be copolymerized with ethylene and an optional additional comonomer to form an interpolymer of ethylene, the functional comonomer and optionally other comonomer(s). Means for grafting functional groups onto polyethylene are described for example in U.S. Pat. Nos. 4,762,890, 4,927,888, and 4,950,541, the disclosures of these patents are incorporated herein by reference in their entirety. One particularly useful functional group is malic anhydride.

The amount of the functional group present in the functional interpolymer can vary. The functional group can typically be present in a copolymer-type functionalized interpolymer in an amount of at least about 1.0 weight percent, preferably at least about 5 weight percent, and more preferably at least about 7 weight percent. The functional group will typically be present in a copolymer-type functionalized interpolymer in an amount less than about 40 weight percent, preferably less than about 30 weight percent, and more preferably less than about 25 weight percent.

Other Base Oils

The ethylene α-olefine interpolymer can be used alone or as a blend with other base oils known in the art for preparing the lubricant compositions provided herein. Such base oils are described in Mortier et al., "*Chemistry and Technology of Lubricants,*" 2nd Edition, London, Springer, Chapters 1 and 2 (1996), incorporated herein by reference. Exemplary base oils for use as a blend with the ethylene α-olefin interpolymer as described herein.

In some embodiments, the base oil contains any of the base stocks in Groups I-V as specified in the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV. In certain embodiments, the base oil contains a combination of the base stocks in Groups I-V.

In other embodiments, the base oil contains a natural oil, a synthetic oil or a combination thereof. Non-limiting examples of suitable natural oils include animal oils (e.g., lard oil), vegetable oils (e.g., corn oil, castor oil, and peanut oil), oils derived from coal or shale, mineral oils (e.g., liquid petroleum oils and solvent treated or acid-treated mineral oils of the paraffinic, naphthenic or mixed paraffinic-naphthenic types) and combinations thereof. Non-limiting examples of suitable synthetic lubricating oils include poly-alpha-olefins, alkylated aromatics, polybutenes, aliphatic diesters, polyol esters, polyalkylene glycols, phosphate esters and combinations thereof. In certain embodiments, the base oil contains petroleum base oils known in the art.

In further embodiments, the base oil contains hydrocarbon oils such as polyolefins (e.g., polybutylenes, polypropylenes, propylene isobutylene copolymers, polyhexene, polyoctene, polydecene, and the like); alkylbenzenes (e.g., dodecylbenzenes, tetradecylbenzenes, dinonylbenzenes, di-(2-ethylhexyl)benzenes, and the like); polyphenyls (e.g., biphenyls, terphenyls, alkylated polyphenyls, and the like); alkylated diphenyl ethers; alkylated diphenyl sulfides; and the derivatives, isomers, analogs, homologs and combinations thereof.

In further embodiments, the base oil contains a poly-alpha-olefin (PAO). In general, the poly-alpha-olefins may be derived from an alpha-olefin having from about 2 to about 30, or from about 4 to about 20, or from about 6 to about 16 carbon atoms. Non-limiting examples of suitable poly-alpha-olefins include those derived from octene, decene, mixtures thereof, and the like. These poly-alpha-olefins may have a viscosity from about 2 to about 15, or from about 3 to about 12, or from about 4 to about 8 centistokes at 100° C.

In further embodiments, the base oil contains a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono- and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil contains any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil contains a hydrocarbon prepared by the Fischer-Tropsch process. Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil contains a refined, unrefined, or rerefined oil. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

Oil Additives

Optionally, the lubricant composition may further contain at least an oil additive or a modifier (hereinafter designated as "additive") that can impart or improve any desirable property of the lubricant composition. Any additive known to a person of ordinary skill in the art may be used in the lubricant compositions provided herein. Some suitable additives have been described in Mortier et al., "*Chemistry and Technology of Lubricants,*" 2nd Edition, London, Springer, (1996); and Leslie R. Rudnick, "*Lubricant Additives: Chemistry and Applications*," New York, Marcel Dekker (2003), both of which are incorporated herein by reference. In some embodiments, the additive can be selected from the group consisting of viscosity index improvers, detergents, dispersants, friction modifiers, pour point depressants, demulsifiers, anti-foams, corrosion inhibitors, anti-wear agents, antioxidants, rust inhibitors, and combinations thereof. In general, the concentration of each of the additives in the lubricant composition, when used, can range from about 0.001 to about 20 wt %, from about 0.01 to about 10 wt % or from about 0.1 to about 5 wt %, based on the total weight of the lubricant composition.

Viscosity Index Improvers

In certain embodiments, higher molecular weight ethylene/α-olefin block copolymers described in PCT Application No. PCT/US2005/008917 and U.S. Provisional Application Ser. No. 60/718,129, entitled "VISCOSITY INDEX IMPROVER FOR LUBRICANT COMPOSITIONS", filed in the name of Cheung et al. on Sep. 17, 2005, incorporated by reference in its entirety, are used as viscosity index improvers in the lubricant compositions provided herein. Other suitable viscosity index improvers, or viscosity modifiers for use in the lubricant compositions provided herein, include, but are not limited to olefin polymers, such as polybutene, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethylaminoalkyl methacrylate, post-grafted polymers of ethylene and propylene with an active monomer such as maleic anhydride which may be further reacted with alcohol or an alkylene polyamine, styrene-maleic anhydride polymers post-reacted with alcohols and amines and the like. These are used as required to provide the viscosity range desired in the finished oil in accordance with known formulating techniques.

Detergents

The lubricant composition provided herein can contain a detergent that can control varnish, ring zone deposits, and rust by keeping insoluble particles in colloidal suspension and in some cases, by neutralizing acids. Any detergent known to a person of ordinary skill in the art may be used in the lubricant composition. Non-limiting examples of suitable detergents include metal sulfonates, phenates, salicylates, phosphonates, thiophosphonates and combinations thereof. The metal can be any metal suitable for making sulfonate, phenate, salicylate or phosphonate detergents. Non-limiting examples of suitable metals include alkali metals, alkaline metals and transition metals. In some embodiments, the metal is Ca, Mg, Ba, K, Na, Li or the like. The amount of the detergent may vary from about 0.01 to about 10 wt %, from about 0.05 to about 5 wt %, or from about 0.1 to about 3 wt %, based on the total weight of the lubricant composition. Some suitable detergents have been described in Mortier et al., "*Chemistry and Technology of Lubricants,*" 2nd Edition, London, Springer, Chapter 3, pages 75-85 (1996); and Leslie R. Rudnick, "*Lubricant Additives: Chemistry and Applications*," New York, Marcel Dekker, Chapter 4, pages 113-136 (2003), both of which are incorporated herein by reference.

Dispersants

The lubricant composition provided herein can contain a dispersant that can prevent sludge, varnish, and other deposits by keeping particles suspended in a colloidal state. Any dispersant known to a person of ordinary skill in the art may be used in the lubricant composition. Non-limiting examples of suitable dispersants include succinimides, succiamides, benzylamines, succinate esters, succinate ester-amides, Mannich type dispersants, phosphorus-containing dispersants, boron-containing dispersants and combinations thereof. The amount of the dispersant may vary from about 0.01 to about 10 wt %, from about 0.05 to about 7 wt %, or from about 0.1 to about 4 wt %, based on the total weight of the lubricant composition. Some suitable dispersants have been described in Mortier et al., "*Chemistry and Technology of Lubricants,*" 2nd Edition, London, Springer, Chapter 3, pages 86-90 (1996); and Leslie R. Rudnick, "*Lubricant Additives: Chemistry and Applications*," New York, Marcel Dekker, Chapter 5, pages 137-170 (2003), both of which are incorporated herein by reference.

Friction Modifiers

The lubricant composition provided herein can contain a friction modifier that can lower the friction between moving parts. Any friction modifier known to a person of ordinary skill in the art may be used in the lubricant composition. Non-limiting examples of suitable friction modifiers include fatty carboxylic acids; derivatives (e.g., esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments, the friction modifier is selected from the group consisting of aliphatic amines, ethoxylated aliphatic amines, aliphatic carboxylic acid amides, ethoxylated aliphatic ether amines, aliphatic carboxylic acids, glycerol esters, aliphatic carboxylic ester-amides, fatty imidazolines, fatty tertiary amines, wherein the aliphatic or fatty group contains more than about eight carbon atoms so as to render the compound suitably oil soluble. In other embodiments, the friction modifier contains an aliphatic substituted succinimide formed by reacting an aliphatic succinic acid or anhydride with ammonia or a primary amine. The amount of the friction modifier may vary from about 0.01 to about 10 wt %, from about 0.05 to about 5 wt %, or from about 0.1 to about 3 wt %, based on the total weight of the lubricant composition. Some suitable friction modifiers have been described in Mortier et al., "*Chemistry and Technology of Lubricants,*" 2nd Edition, London, Springer, Chapter 6, pages 183-187 (1996); and Leslie R. Rudnick, "*Lubricant Additives: Chemistry and Applications*," New York, Marcel Dekker, Chapters 6 and 7, pages 171-222 (2003), both of which are incorporated herein by reference.

Pour Point Depressants

The lubricant composition provided herein can contain a pour point depressant that can lower the pour point of the lubricant composition. Any pour point depressant known to a person of ordinary skill in the art may be used in the lubricant composition. Non-limiting examples of suitable pour point depressants include polymethacrylates, polyacrylates, di(tetra-paraffin phenol)phthalate, condensates of tetra-paraffin phenol, condensates of a chlorinated paraffin with naphthalene and combinations thereof. In some embodiments, the pour point depressant contains an ethylene-vinyl acetate copolymer, a condensate of chlorinated paraffin and phenol, polyalkyl styrene or the like. The amount of the pour point depressant may vary from about 0.01 to about 10 wt %, from about 0.05 to about 5 wt %, or from about 0.1 to about 3 wt %, based on the total weight of the lubricant composition. Some suitable pour point depressants have been described in Mortier et al., "*Chemistry and Technology of Lubricants,*" 2nd Edition, London, Springer, Chapter 6, pages 187-189 (1996); and Leslie R. Rudnick, "*Lubricant Additives: Chemistry and Applications*," New York, Marcel Dekker, Chapter 11, pages 329-354 (2003), both of which are incorporated herein by reference.

Demulsifiers

The lubricant composition provided herein can contain a demulsifier that can promote oil-water separation in lubricant compositions that are exposed to water or steam. Any demulsifier known to a person of ordinary skill in the art may be used in the lubricant composition. Non-limiting examples of suitable demulsifiers include anionic surfactants (e.g., alkylnaphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids and combinations thereof. The amount of the demulsifier may vary from about 0.01 to about 10 wt %, from about 0.05 to about 5 wt %, or from about 0.1 to about 3 wt %, based on the total weight of the lubricant composition. Some suitable demulsifiers have been described in Mortier et al., "*Chemistry and Technology of Lubricants,*" 2nd Edition, London, Springer, Chapter 6, pages 190-193 (1996), which is incorporated herein by reference.

Anti-Foams

The lubricant composition provided herein can contain an anti-foam that can break up foams in oils. Any anti-foam known to a person of ordinary skill in the art may be used in the lubricant composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, polyacrylates, polyalkoxyamines and combinations thereof. In some embodiments, the anti-foam contains glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.01 to about 5 wt %, from about 0.05 to about 3 wt %, or from about 0.1 to about 1 wt %, based on the total weight of the lubricant composition. Some suitable anti-foams have been described in Mortier et al., "*Chemistry and Technology of Lubricants,*" 2nd Edition, London, Springer, Chapter 6, pages 190-193 (1996), which is incorporated herein by reference.

Corrosion Inhibitors

The lubricant composition provided herein can contain a corrosion inhibitor that can reduce corrosion. Any corrosion inhibitor known to a person of ordinary skill in the art may be used in the lubricant composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 to about 5 wt %, from about 0.05 to about 3 wt %, or from about 0.1 to about 1 wt %, based on the total weight of the lubricant composition. Some suitable corrosion inhibitors have been described in Mortier et al., "*Chemistry and Technology of Lubricants,*" 2nd Edition, London, Springer, Chapter 6, pages 193-196 (1996), which is incorporated herein by reference.

Anti-Wear Agents

The lubricant composition provided herein can contain an anti-wear agent that can reduce friction and excessive wear. Any anti-wear agent known to a person of ordinary skill in the art may be used in the lubricant composition. Non-limiting examples of suitable anti-wear agents include zinc dithiophosphate, metal (e.g., Pb, Sb, Mo and the like) salts of dithiophosphate, metal (e.g., Zn, Pb, Sb, Mo and the like) salts of dithiocarbamate, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 to about 5 wt %, from about 0.05 to about 3 wt %, or from about 0.1 to about 1 wt %, based on the total weight of the lubricant composition. Some suitable anti-wear agents have been described in Leslie R. Rudnick, "*Lubricant Additives: Chemistry and Applications*," New York, Marcel Dekker, Chapter 8, pages 223-258 (2003), which is incorporated herein by reference.

Extreme Pressure (EP) Agents

The lubricant composition provided herein can contain an extreme pressure (EP) agent that can prevent sliding metal surfaces from seizing under conditions of extreme pressure. Any extreme pressure agent known to a person of ordinary skill in the art may be used in the lubricant composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 to about 5 wt %, from about 0.05 to about 3 wt %, or from about 0.1 to about 1 wt %, based on the total weight of the lubricant composition. Some suitable extreme pressure agents have been described in Leslie R. Rudnick, "*Lubricant Additives: Chemistry and Applications*," New York, Marcel Dekker, Chapter 8, pages 223-258 (2003), which is incorporated herein by reference.

Antioxidants

The lubricant composition provided herein can contain an antioxidant that can reduce or prevent the oxidation of the base oil. Any antioxidant known to a person of ordinary skill in the art may be used in the lubricant composition. Non-limiting examples of suitable antioxidants include amine-based antioxidants (e.g., alkyl diphenylamines, phenyl-α-naphthylamine, alkyl or aralkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 to about 10 wt %, from about 0.05 to about 5%, or from about 0.1 to about 3%, based on the total weight of the lubricant composition. Some suitable antioxidants have been described in Leslie R. Rudnick, "*Lubricant Additives: Chemistry and Applications*," New York, Marcel Dekker, Chapter 1, pages 1-28 (2003), which is incorporated herein by reference.

Rust Inhibitors

The lubricant composition provided herein can contain a rust inhibitor that can inhibit the corrosion of ferrous metal surfaces. Any rust inhibitor known to a person of ordinary skill in the art may be used in the lubricant composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha,omega-dicarboxylic acids having a molecular weight in the range of 600 to 3000 daltons and combinations thereof. The amount of the rust inhibitor may vary from about 0.01 to about 10 wt %, from about 0.05 to about 5%, or from about 0.1 to about 3%, based on the total weight of the lubricant composition.

Diluents

The additives may be in the form of an additive concentrate having more than one additive. The additive concentrate can contain a suitable diluent, most preferably a hydrocarbon oil of suitable viscosity. Such diluent can be selected from the group consisting of natural oils (e.g., mineral oils), synthetic oils and combinations thereof. Non-limiting examples of the mineral oils include paraffin-based oils, naphthenic-based oils, asphaltic-based oils and combinations thereof. Non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity in the range of 13 to 35 centistokes at 40° C.

Uses

The lubricant composition provided herein may be suitable for use as motor oils (or engine oils or crankcase oils), transmission fluids, gear oils, power steering fluids, shock absorber fluids, brake fluids, hydraulic fluids and/or greases.

Motor Oil

In some embodiments, the lubricant composition provided herein is a motor oil. Such a motor oil composition may be used to lubricate all major moving parts in any reciprocating internal combustion engine, reciprocating compressors and in steam engines of crankcase design. In automotive applications, the motor oil composition may also be used to cool hot engine parts, keep the engine free of rust and deposits, and seal the rings and valves against leakage of combustion gases. The motor oil composition can contain a base oil and the ethylene/α-olefin interpolymer. The motor oil composition may further contain at least an additive. In some embodiments, the motor oil composition further contains a pour point depressant, a detergent, a dispersant, an anti-wear, an antioxidant, a friction modifier, a rust inhibitor, or a combination thereof.

Gear Oil

In other embodiments, the lubricant composition provided herein is a gear oil for either automotive or industrial applications. The gear oil composition may be used to lubricate gears, rear axles, automotive transmissions, final drive axles, accessories in agricultural and construction equipment, gear housings and enclosed chain drives. The gear oil composition can contain a base oil and the ethylene/α-olefin interpolymer. The gear oil composition may further contain at least an additive. In some embodiments, the gear oil composition further contains an anti-wear, an extreme pressure agent, a rust inhibitor, or a combination thereof.

Transmission Fluid

In further embodiments, the lubricant composition provided herein is a transmission fluid. The transmission fluid composition may be used in either automatic transmission or manual transmission to reduce transmission losses. The transmission fluid composition can contain a base oil and the ethylene/α-olefin interpolymer. The transmission fluid composition may further contain at least an additive. In some embodiments, the transmission fluid composition further contains a friction modifier, a detergent, a dispersant, an antioxidant, an anti-wear agent, an extreme pressure agent, a pour point depressant, an anti-foam, a corrosion inhibitor or a combination thereof.

Grease

In further embodiments, the lubricant composition provided herein is a grease used in various applications where extended lubrication is required and where oil would not be retained, e.g., on a vertical shaft. The grease composition can contain a base oil, the ethylene/α-olefin interpolymer and a thickener. In some embodiments, the grease composition further contain a complexing agent, an antioxidant, an anti-wear agent, an extreme pressure agent, an anti-foam, a corrosion inhibitor or a mixture thereof. In some embodiments, the thickener is a soap formed by reacting a metal hydroxide (e.g., lithium hydroxide, sodium hydroxide, potassium hydroxide, calcium hydroxide, zinc hydroxide and the like) with a fat, a fatty acid, or an ester. In general, the type of soap used depends on the grease properties desired. In other embodiments, the thickener may be a non-soap thickener selected from the group consisting of clays, silica gels, carbon black, various synthetic organic materials and combinations thereof. In further embodiments, the thickener contains a combination of soaps and non-soap thickeners.

General Processes of Preparing Lubricant Compositions

The lubricant compositions provided herein can be prepared by any method known to a person of ordinary skill in the art for making lubricating oils. In some embodiments, the ethylene/α-olefin interpolymer base oil can be blended or mixed with at least one additive. In the embodiments, where the compositions contain more than one additive, the additives are added to the ethylene/α-olefin interpolymer base oil individually in one or more additions and the additions may be in any order. In some embodiments, the solubilizing of the additives in the ethylene/α-olefin interpolymer base oil can be assisted by heating the mixture to a temperature between about 25 and about 200° C., from about 50 and about 150° C. or from about 75 and about 125° C.

Any mixing or dispersing equipment known to a person of ordinary skill in the art may be used for blending, mixing or solubilizing the ingredients. The blending, mixing or solubilizing may be carried out with a blender, an agitator, a disperser, a mixer (e.g., Ross double planetary mixers and Collette planetary mixers), a homogenizer (e.g., Gaulin homogeneizers and Rannie homogeneizers), a mill (e.g., colloid mill, ball mill and sand mill) or any other mixing or dispersing equipment known in the art.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

EXAMPLES

ATREF

Analytical temperature rising elution fractionation (ATREF) analysis is conducted according to the method described in U.S. Pat. No. 4,798,081 and Wilde, L.; Ryle, T. R.; Knobeloch, D. C.; Peat, I. R.; *Determination of Branching*

*Distributions in Polyethylene and Ethylene Copolymers*, J. Polym. Sci., 20, 441-455 (1982), which are incorporated by reference herein in their entirety. The composition to be analyzed is dissolved in trichlorobenzene and allowed to crystallize in a column containing an inert support (stainless steel shot) by slowly reducing the temperature to 20° C. at a cooling rate of 0.1° C./min. The column is equipped with an infrared detector. An ATREF chromatogram curve is then generated by eluting the crystallized polymer sample from the column by slowly increasing the temperature of the eluting solvent (trichlorobenzene) from 20 to 120° C. at a rate of 1.5° C./min.

$^{13}$C NMR Analysis

The samples are prepared by adding approximately 3 g of a 50/50 mixture of tetrachloroethane-d$^2$/orthodichlorobenzene to 0.4 g sample in a 10 mm NMR tube. The samples are dissolved and homogenized by heating the tube and its contents to 150° C. The data are collected using a JEOL Eclipse™ 400 MHz spectrometer or a Varian Unity Plus™ 400 MHz spectrometer, corresponding to a $^{13}$C resonance frequency of 100.5 MHz. The data are acquired using 4000 transients per data file with a 6 second pulse repetition delay. To achieve minimum signal-to-noise for quantitative analysis, multiple data files are added together. The spectral width is 25,000 Hz with a minimum file size of 32K data points. The samples are analyzed at 130° C. in a 10 mm broad band probe. The comonomer incorporation is determined using Randall's triad method (Randall, J. C.; JMS-Rev. Macromol. Chem. Phys., C29, 201-317 (1989), which is incorporated by reference herein in its entirety.

Catalysts

The term "overnight", if used, refers to a time of approximately 16-18 hours, the term "room temperature", refers to a temperature of 20-25° C., and the term "mixed alkanes" refers to a commercially obtained mixture of $C_{6-9}$ aliphatic hydrocarbons available under the trade designation Isopar E®, from Exxon Mobil Chemical Company. In the event the name of a compound herein does not conform to the structural representation thereof, the structural representation shall control. The synthesis of all metal complexes and the preparation of all screening experiments were carried out in a dry nitrogen atmosphere using dry box techniques. All solvents used were HPLC grade and were dried before their use.

MMAO refers to modified methylalumoxane, a triisobutylaluminum modified methylalumoxane available commercially from Akzo-Noble Corporation.

The preparation of catalyst (B1) is conducted as follows.

a) Preparation of (1-methylethyl)(2-hydroxy-3,5-di (t-butyl)phenyl)methylimine 3,5-Di-t-butylsalicylaldehyde (3.00 g) is added to 10 mL of isopropylamine. The solution rapidly turns bright yellow. After stirring at ambient temperature for 3 hours, volatiles are removed under vacuum to yield a bright yellow, crystalline solid (97 percent yield).

b) Preparation of 1,2-bis-(3,5-di-t-butylphenylene) (1-(N-(1-methylethyl)immino)methyl)-(2-oxoyl) zirconium dibenzyl A solution of (1-methylethyl)(2-hydroxy-3,5-di(t-butyl) phenyl)imine (605 mg, 2.2 mmol) in 5 mL toluene is slowly added to a solution of $Zr(CH_2Ph)_4$ (500 mg, 1.1 mmol) in 50 mL toluene. The resulting dark yellow solution is stirred for 30 min. Solvent is removed under reduced pressure to yield the desired product as a reddish-brown solid.

The preparation of catalyst (B2) is conducted as follows.

a) Preparation of (1-(2-methylcyclohexyl)ethyl)(2-oxoyl-3,5-di(t-butyl)phenyl)imine 2-Methylcyclohexylamine (8.44 mL, 64.0 mmol) is dissolved in methanol (90 mL), and di-t-butylsalicaldehyde (10.00 g, 42.67 mmol) is added. The reaction mixture is stirred for three hours and then cooled to −25° C. for 12 hrs. The resulting yellow solid precipitate is collected by filtration and washed with cold methanol (2×15 mL), and then dried under reduced pressure. The yield is 11.17 g of a yellow solid. $^1$H NMR is consistent with the desired product as a mixture of isomers.

Preparation of bis-(1-(2-methylcyclohexyl)ethyl)(2-oxoyl-3,5-di(t-butyl)phenyl)immino)zirconium dibenzyl A solution of (1-(2-methylcyclohexyl)ethyl)(2-oxoyl-3,5-di(t-butyl)phenyl)imine (7.63 g, 23.2 mmol) in 200 mL toluene is slowly added to a solution of $Zr(CH_2Ph)_4$ (5.28 g, 11.6 mmol) in 600 mL toluene. The resulting dark yellow solution is stirred for 1 hour at 25° C. The solution is diluted further with 680 mL toluene to give a solution having a concentration of 0.00783 M.

Cocatalyst 1 A mixture of methyldi($C_{14-18}$ alkyl)ammonium salts of tetrakis(pentafluorophenyl)borate (here-in-after armeenium borate), prepared by reaction of a long chain trialkylamine (Armeen™ M2HT, available from Akzo-Nobel, Inc.), HCl and $Li[B(C_6F_5)_4]$, substantially as disclosed in U.S. Pat. No. 5,919,9883, Ex. 2.

Cocatalyst 2 Mixed $C_{14-18}$ alkyldimethylammonium salt of bis(tris(pentafluorophenyl)-alumane)-2-undecylimidazolide, prepared according to U.S. Pat. No. 6,395,671, Ex. 16.

Shuttling Agents The shuttling agents employed include diethylzinc (DEZ, SA1), di(i-butyl)zinc (SA2), di(n-hexyl) zinc (SA3), triethylaluminum (TEA, SA4), trioctylaluminum (SA5), triethylgallium (SA6), i-butylaluminum bis(dimethyl (t-butyl)siloxane) (SA7), i-butylaluminum bis(di(trimethylsilyl)amide) (SA8), n-octylaluminum di(pyridine-2-methoxide) (SA9), bis(n-octadecyl)i-butylaluminum (SA10), i-butylaluminum bis(di(n-pentyl)amide) (SA11), n-octylaluminum bis(2,6-di-t-butylphenoxide) (SA12), n-octylaluminum di(ethyl(1-naphthyl)amide) (SA13), ethylaluminum bis (t-butyldimethylsiloxide) (SA14), ethylaluminum di(bis (trimethylsilyl)amide) (SA15), ethylaluminum bis(2,3,6,7-dibenzo-1-azacycloheptaneamide) (SA16), n-octylaluminum bis(2,3,6,7-dibenzo-1-azacycloheptaneamide) (SA17), n-octylaluminum bis(dimethyl(t-butyl)siloxide(SA18), ethylzinc (2,6-diphenylphenoxide) (SA19), and ethylzinc (t-butoxide) (SA20).

General High Throughput Parallel Polymerization Conditions

Polymerizations are conducted using a high throughput, parallel polymerization reactor (PPR) available from Symyx technologies, Inc. and operated substantially according to U.S. Pat. Nos. 6,248,540, 6,030,917, 6,362,309, 6,306,658, and 6,316,663. Ethylene copolymerizations are conducted at 130° C. and 200 psi (1.4 MPa) with ethylene on demand using 1.2 equivalents of cocatalyst 1 based on total catalyst used (1.1 equivalents when MMAO is present). A series of polymerizations are conducted in a parallel pressure reactor (PPR) comprised of 48 individual reactor cells in a 6×8 array that are fitted with a pre-weighed glass tube. The working volume in each reactor cell is 6000 μL. Each cell is temperature and pressure controlled with stirring provided by individual stirring paddles. The monomer gas and quench gas are plumbed directly into the PPR unit and controlled by automatic valves. Liquid reagents are robotically added to each reactor cell by syringes and the reservoir solvent is mixed alkanes. The order of addition is mixed alkanes solvent (4 ml), ethylene, 1-octene comonomer (1 ml), cocatalyst 1 or cocatalyst 1/MMAO mixture, shuttling agent, and catalyst or catalyst mixture. When a mixture of cocatalyst 1 and MMAO or a mixture of two catalysts is used, the reagents are premixed in a small vial immediately prior to addition to the reactor. When a reagent is omitted in an experiment, the above order of addition is otherwise maintained. Polymerizations are conducted for approximately 1-2 minutes, until predetermined ethylene consumptions are reached. After quenching with CO, the reactors are cooled and the glass tubes are unloaded. The tubes are transferred to a centrifuge/vacuum drying unit, and dried for 12 hours at 60° C. The tubes containing dried polymer are weighed and the difference between this weight and the tare weight gives the net yield of polymer.

The lubricants made in accordance with embodiments of the invention may have one or more of the following advantages: improved shear stability; oxidative stability; and cost effectiveness.

Example 1

The inventive low molecular weight interpolymer is an ethylene/1-octene olefin copolymer having a composite 1-octene content of 85 wt. %, a density of 0.851 g/cc, a DSC peak melting point of −10° C., a heat of fusion of 2 J/g, 2000 g/mole, a weight average molecular weight of 4500 g/mole a Brookfield viscosity at 100° C. of 15 cST and a pour point of −5° C. It has an average block index of 0.65 and has at least three ATREF fractions that have a block index of at least 0.5 (0.6; 0.8; and 0.8). The copolymer is useful as a lubricating oil.

While the invention has been described with respect to a limited number of embodiments, the specific features of one embodiment should not be attributed to other embodiments of the invention. No single embodiment is representative of all aspects of the invention. In some embodiments, the compositions or methods may include numerous compounds or steps not mentioned herein. In other embodiments, the compositions or methods do not include, or are substantially free of, any compounds or steps not enumerated herein. Variations and modifications from the described embodiments exist. Finally, any number disclosed herein should be construed to mean approximate, regardless of whether the word "about" or "approximately" is used in describing the number. The appended claims intend to cover all those modifications and variations as falling within the scope of the invention.

What is claimed is:

1. A lubricant composition comprising a base oil and at least one oil additive, wherein the base oil comprises an ethylene/α-olefin multi-block interpolymer having a number average molecular weight of less than 10,000 g/mol and wherein the ethylene/α-olefin interpolymer has a comonomer content of a TREF fraction which elutes between 40° C. and 130° C. greater than or equal to the quantity (−0.2013)T+21.07 where T is the numerical value of the peak elution temperature of the TREF fraction being compared, measured in ° C.

2. A lubricant composition comprising a base oil and at least one oil additive, wherein the base oil comprises an ethylene/α-olefin multi-block interpolymer having:

(a) at least one molecular fraction which elutes between 40° C. and 130° C. when fractionated using TREF, characterized in that the fraction has a block index of at least 0.5 and up to about 1 and a molecular weight distribution, Mw/Mn, greater than about 1.3 or (b) an average block index greater than zero and up to about 1.0 and a molecular weight distribution, Mw/Mn, greater than about 1.3.

3. The lubricant composition of claim 1, wherein the ethylene/α-olefin interpolymer has a number average molecular weight range from about 1,000 to about 5,000 g/mole.

4. The lubricant composition of claim 1, wherein the ethylene/α-olefin interpolymer has a molecular weight distribution range from about 1.5 to 4.0.

5. The lubricant composition of claim 1, wherein the ethylene/α-olefin interpolymer has a Brookfield viscosity of about 5 to 30 cSt at 100° C.

6. The lubricant composition of claim 1, wherein the ethylene/α-olefin interpolymer has a pour point of below about 0° C.

7. The lubricant composition of claim 1, wherein the ethylene/α-olefin interpolymer comprises a $C_3$-$C_{20}$ α-olefin.

8. The lubricant composition of claim 1, wherein the ethylene/α-olefin interpolymer comprises a $C_6$-$C_{18}$ α-olefin.

9. The lubricant composition of claim 1, wherein the ethylene/α-olefin interpolymer comprises a $C_{10}$-$C_{20}$ α-olefin.

10. The lubricant composition of claim 1, wherein the ethylene/α-olefin interpolymer comprises decene.

11. The lubricant composition of claim 1, wherein the ethylene/α-olefin interpolymer comprises dodecene.

12. The lubricant composition of claim 1, wherein the base oil further comprises an oil selected from a group consisting of a base stock of API Groups I, II, III, IV, V and combinations thereof.

13. The lubricant composition of claim 1, wherein the base oil further comprises is a natural oil, a synthetic oil or a combination thereof.

14. The lubricant composition of claim 1, wherein the additive is a viscosity index improver, a detergent, a dispersant, a friction modifier, a pour point depressant, a demulsifier, an anti-foam, a corrosion inhibitor, an anti-wear agent, an antioxidant, a rust inhibitor, a thickener, or a combination thereof.

15. The lubricant composition of claim 1, wherein the additive is a viscosity index improver.

16. The lubricant composition of claim 15, wherein the viscosity index improver is a higher molecular weight ethylene/α-olefin block copolymer.

17. The lubricant composition of claim 1, wherein the lubricant composition is a motor oil, a transmission fluid, a gear oil, a power steering fluid, a shock absorber fluid, a brake fluid, a hydraulic fluid or a grease.

18. The lubricant composition of claim 17 wherein the lubricant composition is a motor oil.

19. The lubricant composition of claim 18, wherein the motor oil further comprises a viscosity index improver, a pour point depressant, a detergent, a dispersant, an anti-wear, an antioxidant, a friction modifier, a rust inhibitor or a combination thereof.

20. The lubricant composition of claim 19, wherein the lubricant composition is a transmission fluid.

21. The lubricant composition of claim 20, wherein the transmission fluid further comprises a viscosity index improver, a friction modifier, a detergent, a dispersant, an antioxidant, an anti-wear agent, an extreme pressure agent, a pour point depressant, an anti-foam, a corrosion inhibitor or a combination thereof.

22. The lubricant composition of claim 17, wherein the lubricant composition is a gear oil.

23. The lubricant composition of claim 22, wherein the gear oil further comprises a viscosity index improver, an anti-wear, an extreme pressure agent, a rust inhibitor or a combination thereof.

24. The lubricant composition of claim 17, wherein the lubricant composition is a grease.

25. The lubricant composition of claim 24, wherein the grease further comprises a viscosity index improver, a thickener, a complexing agent, an antioxidant, an anti-wear agent, an extreme pressure agent, an anti-foam, a corrosion inhibitor or a mixture thereof.

26. The lubricant composition of claim 2, wherein the ethylene/α-olefin interpolymer has at least one molecular fraction which elutes between 40° and 130° C. when fractionated using TREF, characterized in that the fraction has a block index of at least 0.5 and up to about 1 and a molecular weight distribution, Mw/Mn, greater than about 1.3.

27. The lubricant composition of claim 2, wherein the ethylene/α-olefin interpolymer has an average block index greater than zero and up to about 1.0 and a molecular weight distribution, Mw/Mn, greater than about 1.3.

28. The lubricant composition of claim 2, wherein the ethylene/α-olefin interpolymer has a number average molecular weight range from about 1,000 to about 5,000 g/mole.

29. The lubricant composition of claim 2, wherein the ethylene/α-olefin interpolymer has a molecular weight distribution range from about 1.5 to 4.0.

30. The lubricant composition of claim 2, wherein the ethylene/α-olefin interpolymer has a Brookfield viscosity of about 5 to 30 cSt at 100° C.

31. The lubricant composition of claim 2, wherein the ethylene/α-olefin interpolymer has a pour point of below about 0° C.

32. The lubricant composition of claim 2, wherein the ethylene/α-olefin interpolymer comprises a $C_3$-$C_{20}$ α-olefin.

33. The lubricant composition of claim 2, wherein the α-olefin interpolymer comprises a $C_6$-$C_{18}$ α-olefin.

34. The lubricant composition of claim 2, wherein the ethylene/α-olefin interpolymer comprises a $C_{10}$-$C_{20}$ α-olefin.

35. The lubricant composition of claim 2, wherein the ethylene/α-olefin interpolymer comprises decene.

36. The lubricant composition of claim 2, wherein the ethylene/α-olefin interpolymer comprises dodecene.

37. The lubricant composition of claim 2, wherein the base oil further comprises an oil selected from a group consisting of a base stock of API Groups I, II, III, IV, V and combinations thereof.

38. The lubricant composition of claim 2, wherein the base oil further comprises is a natural oil, a synthetic oil or a combination thereof.

39. The lubricant composition of claim 2, wherein the additive is a viscosity index improver, a detergent, a dispersant, a friction modifier, a pour point depressant, a demulsifier, an anti-foam, a corrosion inhibitor, an anti-wear agent, an antioxidant, a rust inhibitor, a thickener, or a combination thereof.

40. The lubricant composition of claim 2, wherein the additive is a viscosity index improver.

41. The lubricant composition of claim 40, wherein the viscosity index improver is a higher molecular weight ethylene/α-olefin block copolymer.

42. The lubricant composition of claim 2, wherein the lubricant composition is a motor oil, a transmission fluid, a gear oil, a power steering fluid, a shock absorber fluid, a brake fluid, a hydraulic fluid or a grease.

43. The lubricant composition of claim 42, wherein the lubricant composition is a motor oil.

44. The lubricant composition of claim 43 wherein, the motor oil further comprises a viscosity index improver, a pour point depressant, a detergent, a dispersant, an anti-wear, a friction modifier, a rust inhibitor or a combination thereof.

45. The lubricant composition of claim 42, wherein the lubricant composition is a transmission fluid.

46. The lubricant composition of claim 45, wherein the transmission fluid further comprises a viscosity index improver, a friction modifier, a detergent, a dispersant, an anti-oxidant, an anti-wear agent, an extreme pressure agent, a pour point depressant, an anti-foam, a corrosion inhibitor or a combination thereof.

47. The lubricant composition of claim 42, wherein the lubricant composition is a gear oil.

48. The lubricant composition of claim 47, wherein the gear oil further comprises a viscosity index improver, an anti-wear, an extreme pressure agent, a rust inhibitor or a combination thereof.

49. The lubricant composition of claim 42, wherein the lubricant composition is a grease.

50. The lubricant composition of claim 49, wherein the grease further comprises a viscosity index improver, a thickener, a complexing agent, an antioxidant, an anti-wear agent, an extreme pressure agent, an anti-foam, a corrosion inhibitor or a mixture thereof.

* * * * *